US005528815A

United States Patent [19]

Webb

[11] Patent Number: 5,528,815

[45] Date of Patent: Jun. 25, 1996

[54] CLINCHING TOOL FOR SHEET METAL JOINING

[76] Inventor: Edward L. T. Webb, 30 Stuart Street, Helensburgh, New South Wales, 2508, Australia

[21] Appl. No.: 304,428

[22] Filed: Sep. 12, 1994

Related U.S. Application Data

[63] Continuation of Ser. No. 930,519, filed as PCT/AU91/00120, Mar. 28, 1991 published as WO91/15316, Oct. 17, 1991, abandoned.

[30] Foreign Application Priority Data

Apr. 3, 1990 [AU] Australia ..... PJ9434

[51] Int. Cl.[6] ..... B21D 39/00; B23P 11/00

[52] U.S. Cl. ..... 29/509; 29/243.5; 29/283.5

[58] Field of Search ..... 29/509, 512, 243.5, 29/283.5

[56] References Cited

U.S. PATENT DOCUMENTS

| | | |
|---|---|---|
| 2,288,308 | 6/1942 | Williams . |
| 2,671,361 | 3/1954 | Sandberg . |
| 2,688,890 | 9/1954 | Williams . |
| 2,924,312 | 2/1960 | Williams . |
| 3,359,935 | 12/1967 | Rosbottom . |
| 4,208,776 | 6/1980 | Schleicher . |
| 4,459,735 | 7/1984 | Sawdon . |
| 4,569,111 | 2/1986 | Mutou . |
| 4,614,017 | 9/1986 | Eckold . |
| 4,757,609 | 7/1988 | Sawdon . |

FOREIGN PATENT DOCUMENTS

| | | |
|---|---|---|
| 41849/85 | 11/1985 | Australia . |
| 78468/87 | 7/1988 | Australia . |
| 38806/89 | 3/1990 | Australia . |
| 62-148034 | 7/1987 | Japan . |
| 63-192524 | 8/1988 | Japan . |
| 708236 | 4/1954 | United Kingdom . |
| 2069394 | 8/1981 | United Kingdom . |
| 2087284 | 5/1982 | United Kingdom . |
| 2189175 | 10/1987 | United Kingdom . |

*Primary Examiner*—Joseph M. Gorski
*Attorney, Agent, or Firm*—Poms, Smith, Lande & Rose

[57] ABSTRACT

A clinching apparatus (1) including a top die (3) comprising a plurality of forming elements (5), and guide means to force the forming elements (5) into close abutment in a closed configuration in response to movement in a first direction to define a void (16) and to permit the forming elements (5) to move apart into an open configuration in response to movement in second opposite direction. A centrally disposed floating bottom die (22) is disposed intermediate the forming elements to define a lower boundary of the void. A punch (20) is operable with the dies (3,22) to force overlapping portions of sheet material (2) into the void to form a clinch (21), whilst displacing the bottom die in the first direction. Clamping means (30) clamp the sheet material against the top die and thereby close the top die. First bias means (25) provide a restoring force on the bottom die upon withdrawal of the punch and an ejecting force tending to open the top die upon disengagement of the clamping means.

32 Claims, 11 Drawing Sheets

CLINCHING TOOL FOR SHEET METAL JOINING

This is a continuation of application Ser. No. 07/930,519, filed as PCT/AU91/00120, Mar. 28, 1991 published as WO91/15316, Oct. 17, 1991 and now abandoned.

FIELD OF THE INVENTION

The present invention relates to fastening tools and in particular to a clinching apparatus for joining overlapping portions of sheet material without the need for independent fastening elements such as rivets or nails, The invention has been developed primarily for use with sheet metal and will be described hereinafter with reference to this application. However, it will be appreciated that the invention is not limited to this particular field of use,

BACKGROUND OF THE INVENTION

Various clinching tools are known and usually comprise a punch operable in conjunction with a complementary die to plasticly deform the overlapping portions of metal and form a clinch which fastens the sheets together.

One such device includes a multi-segmented die bounded by a flexible restraining band permitting the die to resiliently open during the clinching operation. In the open configuration, however, particulate debris is permitted to migrate into the clearances between adjacent die segments. Repeated use causes the die to become clogged which prevents efficient operation of the tool.

Known clinching tools also suffer from an additional problem in that the wall thickness of the sheet material in the vicinity of the neck of the clinch tends to be significantly reduced because of the way in which the metal is extruded into the die. In some cases, the wall thickness in the region of the clinch can be reduced by in excess of 80% of the nominal gauge thickness of the metal, which significantly reduces the maximum shear strength of the clinch. In addition, the joint so formed is highly stressed in the vicinity of the clinch and therefore more susceptible to corrosion which directly affects the longevity of the joint. In many applications, for example in the building industry, these problems have prevented the widespread commercial acceptance of clinching as a viable means of assembly and construction in sheet metal because of the resultant difficulty encountered in meeting stringent safety requirements.

In addition to the problems of reduced wall thickness, inadequate shear strength, and reduced corrosion tolerance, the side walls of the die in so called "fixed die" tools must either be parallel or diverge outwardly in order to permit release of the clinch from the die. This inherent restriction in fixed die devices limits the maximum degree of interlocking mechanical engagement between the metal sheets forming the clinch and consequently limits the maximum "pull-out" strength of the joint.

It is therefore an object of the present invention to provide an improved clinching tool which overcomes or substantially ameliorates at least some of these disadvantages of the prior art.

DISCLOSURE OF THE INVENTION

Accordingly, in a first aspect, the invention provides a clinching apparatus for joining overlapping portions of sheet material, said apparatus including a top die comprising a plurality of discrete forming elements, guide means adapted to force said forming elements into close abutment in a closed configuration in response to movement thereof in a first generally axial direction to define a void region bounded by an effectively continuous peripheral surface and adapted to permit the forming elements to move apart into an open configuration in response to movement thereof in a second opposite direction, a centrally disposed floating bottom die defining a lower boundary of said void region and mounted for axial sliding movement intermediate said forming elements, a punch selectively operable in conjunction with said dies to force the sheet material into the void so as to form a clinch fastening the said overlapping portions together and displace the bottom die in the first direction, clamping means engageable independently of the punch to clamp the sheet material against a corresponding upper surface of the top die and thereby move the forming elements in the first direction to close the die, and first bias means to provide a restoring force urging the bottom die in the second direction after axial displacement in the first direction and to provide an ejecting force urging the forming elements toward the open configuration upon disengagement of the clamping means.

Preferably, the bias means further provides an opposing force in response to axial displacement of the bottom die in the first direction.

Preferably, the die comprises at least two complementary collets and the guide means includes a guide block disposed within a body and defining an outwardly diverging generally frusto-conical socket. The collets together preferably define a complementary frusto-conical Outer surface slidingly engageable with the conical socket of the guide block such that movement of the collets into the socket in the first direction causes the collets to be forced tightly together into the closed configuration. Conversely, movement of the collets out of the socket in the second opposite direction permits the collets to move apart into the open configuration to release the clinch from the die.

The bias means preferably includes a first deformable element of predetermined resiliency disposed effectively intermediate the body and the floating bottom die. In one preferred embodiment, a second resilient compression element is disposed effectively intermediate the guide block and the floating die to provide a degree of independent relative movement between the top die, the guide block, the bottom die and the body, thereby to accommodate surface irregularities in the sheet material and provide a degree of gauge tolerance. The resilient compression means may comprise a compressible packing element formed from a suitable material such as LURETHANE, a compressible fluid, or a spring, for example.

In another embodiment, the bias means may include positive drive means such as an hydraulic cylinder acting in conjunction with a tapered wedge member, whereby the floating die is actively driven toward the void during the latter part of the clinching cycle thereby to "flare" the clinch and enhance mechanical interengagement of the overlapping sheets.

Preferably, the clamping means includes a press having a clamping member defining a generally annular clamping surface coaxial with the punch and cooperable with a corresponding opposed upper surface of the top die. In this preferred embodiment, selective actuation of the clamping press forces the clamping member toward the die, thereby clamping the sheet material between the annular clamping surface and the corresponding upper surface of the die. This action simultaneously drives the collets into the complementary frusto-conical socket formed in the guide block to close the die prior to independent actuation of the punch to form the clinch. In the preferred embodiment, the clamping member is formed with an outwardly protruding convex clamping surface configured to force the sheet material into the void during the clinching cycle. Preferably, the clamping surface is partially spherical and incorporates an outwardly protruding annular shoulder surrounding the punch.

The apparatus preferably also includes restraining means to limit the maximum axial excursion of the collets in the second direction relative to the guide block. The restraining means in one embodiment comprises a plurality of locating lugs extending inwardly from the guide block into the conical socket and engaging corresponding oversized apertures formed in the respective collets to provide a limited degree of free play in the first and second directions corresponding to the radial clearance defined between the locating lugs and the respective apertures. In another embodiment, the retaining means comprises a circlip surrounding the remote end of the die, such that the maximum axial excursion of the die in the second direction corresponds to a point at which the circlip abuts a lower surface of the guide block, which is conveniently retained with the body within an interference fit.

In another preferred form of the invention, the collets define a plurality of lobes or protuberances in the void such that the resultant clinch prevents relative rotation of the constituent portions of sheet material. To this end, it will be apparent that a range of non-circular die shapes such as polygonal or elliptical can be used to produce non-rotational joints.

According to a second aspect, the invention provides an independent multi-cylinder actuating device for a clinching apparatus substantially as described above, said actuating device including a first force exerting member reciprocably moveable by a first fluid cylinder, and a second force exerting member reciprocably moveable independently of the first member by a second fluid cylinder, an outer surface of the first member forming an inner surface of the second cylinder such that an operating volume of the second cylinder is defined partly by the first member.

In the preferred embodiment, the actuating device acts in cooperation with the clinching apparatus whereby the first member actuates the punch and the second member independently actuates the clamping press. The first and second cylinders are preferably hydraulic. However, it will be appreciated that pneumatic cylinders, for example, can also be used.

According to a third aspect, the invention provides a clinching assembly comprising a clinching apparatus substantially as described, and an actuating device substantially as described, wherein the first force exerting member actuates the punch and the second force exerting member independently actuates the clamping means.

The actuating device and clinching apparatus are preferably maintained in relative coaxial alignment by a generally C-shaped support frame. In an alternative configuration, however, a pair of clinching apparatus may be supported in spaced apart relationship by a generally E-shaped support frame to enable parallel flanges of a beam to be clinched simultaneously.

According to a fourth aspect, the invention provides a method of joining overlapping portions of sheet material in a clinching apparatus, said method comprising the steps of:

moving a plurality of discrete forming elements in a first direction and thereby forcing said elements together into a closed configuration by guide means to form a top die defining a void region bounded by an effectively continuous peripheral surface;

engaging clamping means to clamp said overlapping portions of sheet material against an upper surface of the top die and thereby retaining the die in the closed configuration;

operating a punch to force the sheet material into the void so as to form a clinch fastening said overlapping portions together and thereby displacing a floating bottom die in the first direction;

withdrawing said punch;

providing a restoring force urging the bottom die in a second opposite direction;

disengaging said clamping means; and providing an ejecting force urging the forming elements in the second opposite direction towards a release configuration.

Preferably, the method includes the further step of providing an opposing force in response to displacement of the bottom die in the first direction.

BRIEF DESCRIPTION OF THE DRAWINGS

Preferred embodiments of the invention will now be described, by way of example only, with reference to the accompanying drawings in which.

PREFERRED EMBODIMENT OF THE INVENTION

Figure 1:
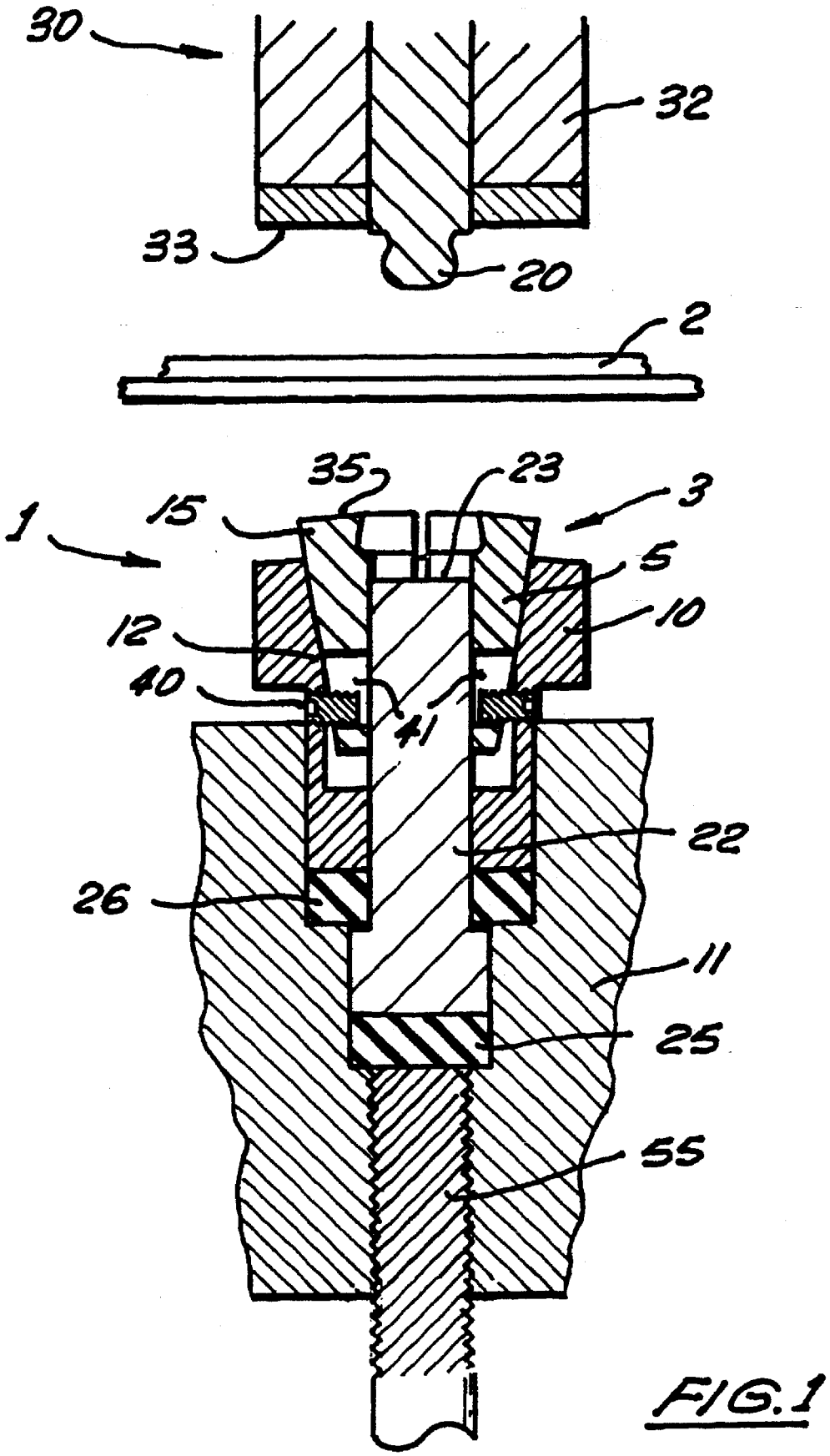
FIG. 1 is a cut-away sectional view of a clinching apparatus according to a first embodiment of the invention with the die in the open configuration.
Figure 3:
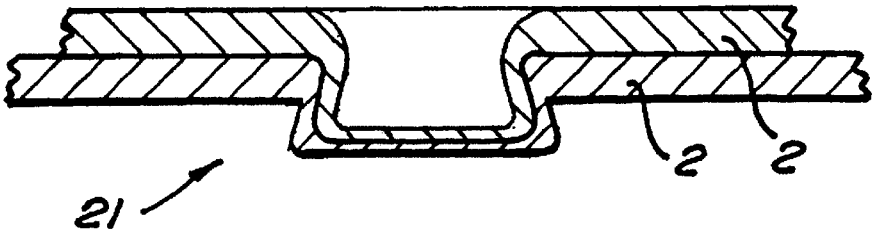
FIG. 3 is a sectional view showing a clinch formed with the tool of FIGS. 1 and 2.
Figure 2:
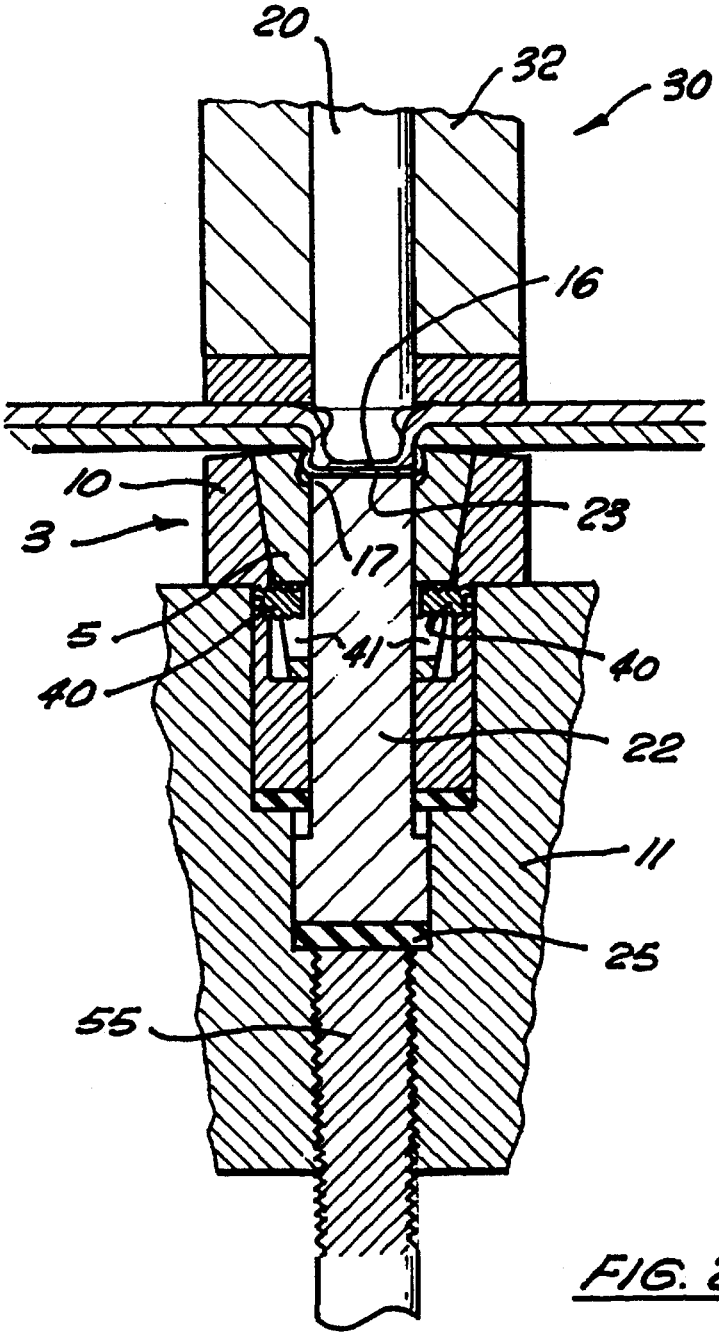
FIG. 2 shows the clinching apparatus of FIG. 1 in operation with the die in the closed configuration.

Referring generally to the drawings, wherein corresponding features are denoted by corresponding reference numerals, a clinching apparatus 1 for joining overlapping portions of sheet material 2 includes a top die 3 comprising a plurality of discrete mutually opposed forming elements in the form of complementary collets 5. The apparatus further includes guide means in the form of guide block 10 disposed within body 11 and defining an outwardly diverging frusto-conical socket 12. The collets 5 together define a complementary frusto-conical outer surface 15 nestably engageable with conical socket 12 of the guide block 10. In this way, movement of the top die into the socket forces the collets into close abutment in a closed configuration (as shown in FIG. 2) to define a void 16 bounded by an effectively continuous peripheral surface 17. Conversely, movement of the die outwardly from the socket 12 away from the guide block permits the collets to move apart into an open configuration as shown in FIG. 1. The sides of the socket 12 are preferably inclined at an angle of around 10° to the vertical. However, this angle can be varied to suit particular applications and material types and thicknesses. For example, with higher loads it is envisaged that an angle of around 15° would be used.

A selectively operable punch 20 having a domed head acts in conjunction with die 3 to force the sheet metal 2 into the void 16 to form a clinch 21 securely fastening the overlapping sheets together. The clinch 21 is released from the die by movement of the collets outwardly from the guide block toward the open configuration.

Figure 4:
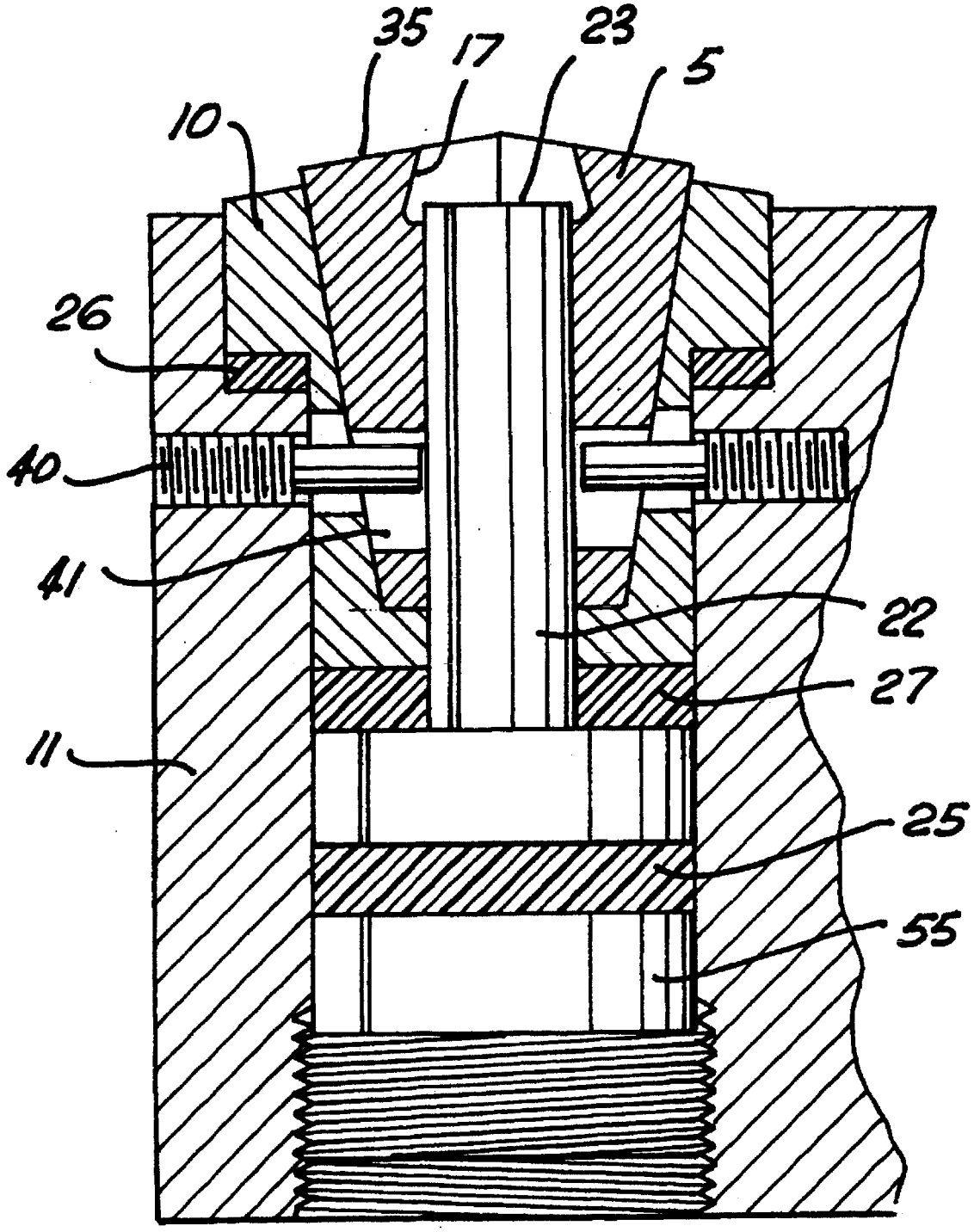
FIG. 4 shows a second embodiment of the clinching apparatus according to the invention.

A floating bottom die member 22 coaxial with punch 20 is mounted for limited independent axial sliding movement within body 11 and between collets 5 to define a lower boundary 23 of the void 16. In the embodiments of FIGS. 1 and 4, the degree of axial sliding movement is passively controlled by bias means in the form of a first deformable compression element 25 of controlled resiliency disposed intermediate the body 11 and the floating bottom die 22. The resilient compression element 25 preferably has a definite end point beyond which substantially no further compressive deformation is possible, and provides a restoring force tending to urge the floating die upwardly toward the void. Similarly, a second resilient annular compression element 26 is disposed effectively between the guide block 10 and a stepped shoulder of the body 11. Resilient compression elements 25 and 26 together provide a limited degree of independent relative movement between top die 3, guide block 10, floating bottom die 22, and body 11, thereby to accommodate surface irregularities in the sheet material and provide a degree of gauge tolerance for the tool. As shown in FIG. 4, an additional compression element 27 may also be interposed effectively between the floating die and the guide block if required.

The resilient elements are preferably formed from a suitable material such as Lurethane which can be appropriately trimmed or "tuned" to provide the required degree of resilient deformation. However, it will be appreciated that various configurations of packing elements or other means such as an adjustably damped viscous hydraulic circuit, or a compressible fluid, could also be used. For example, in the embodiment of FIG. 9, the floating die is urged upwardly toward the void by a spring biased conical wedge member acting against complementary split collets abutting the lower surface of the floating die, as described in more detail below.

Figure 10:
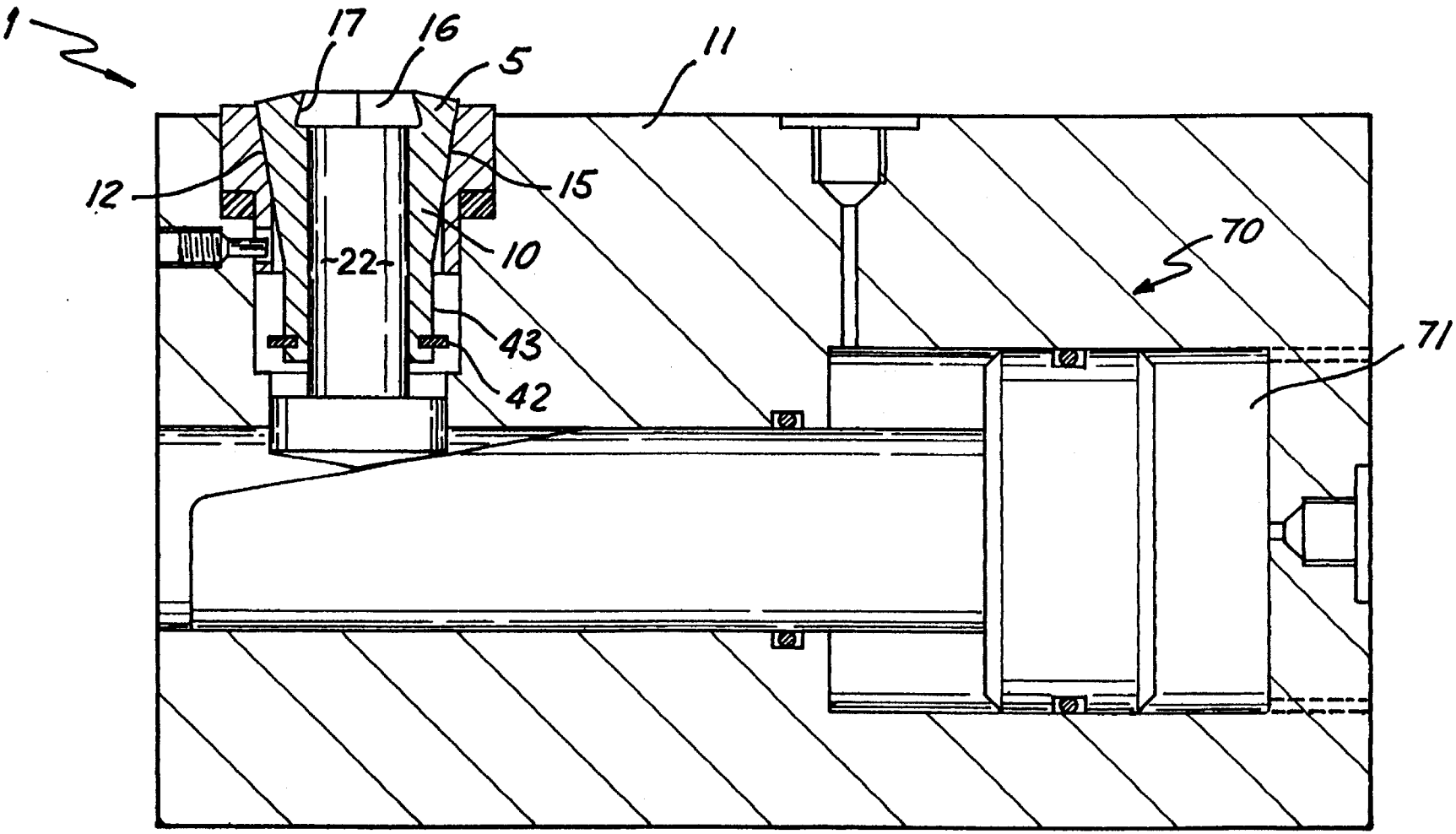
FIG. 10 is a cross sectional view similar to FIG. 9 but incorporating active hydraulic-mechanical drive means.
Figure 11:
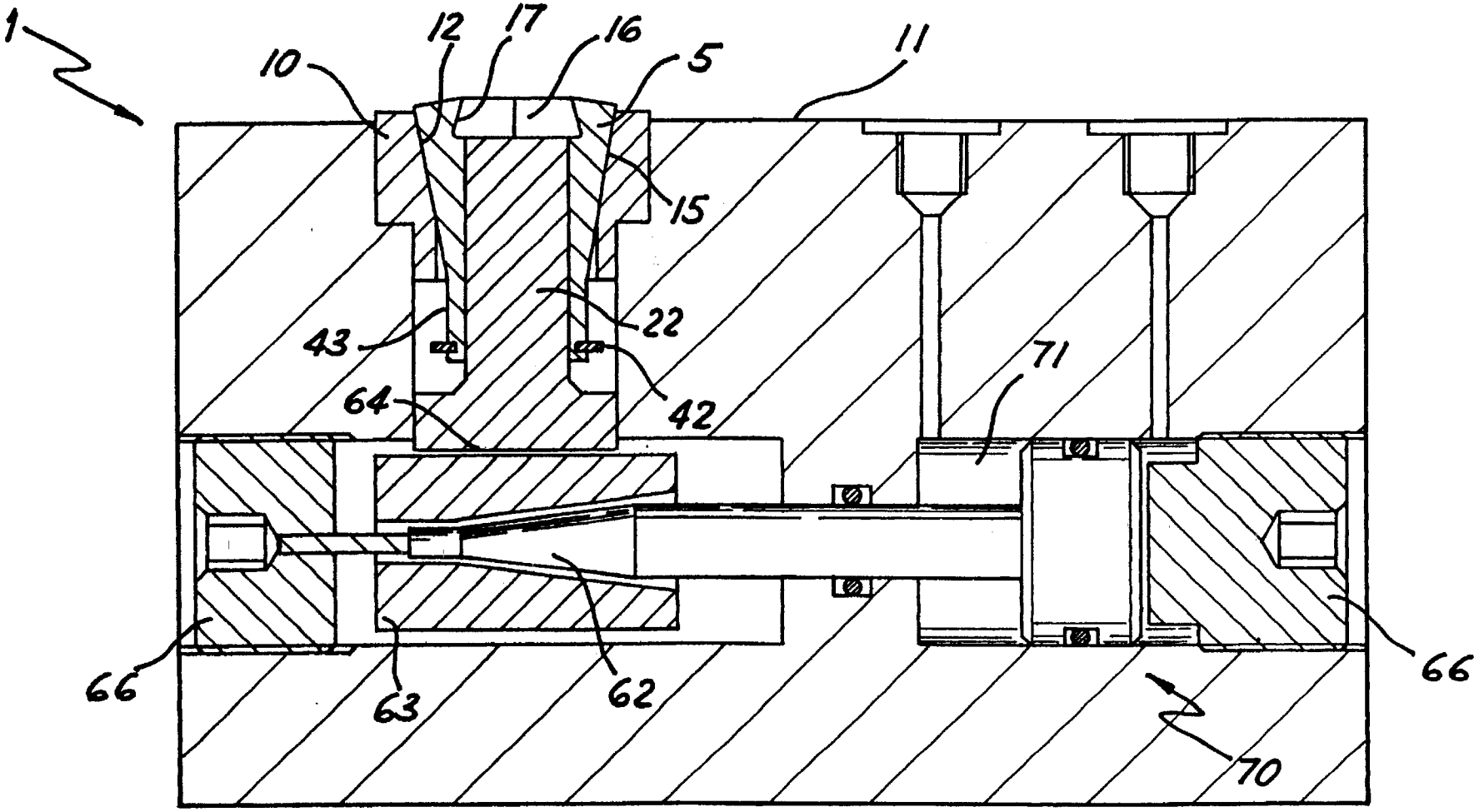
FIG. 11 shows an alternative embodiment of the active hydraulic-mechanical drive means of FIG. 10.
Figure 12:
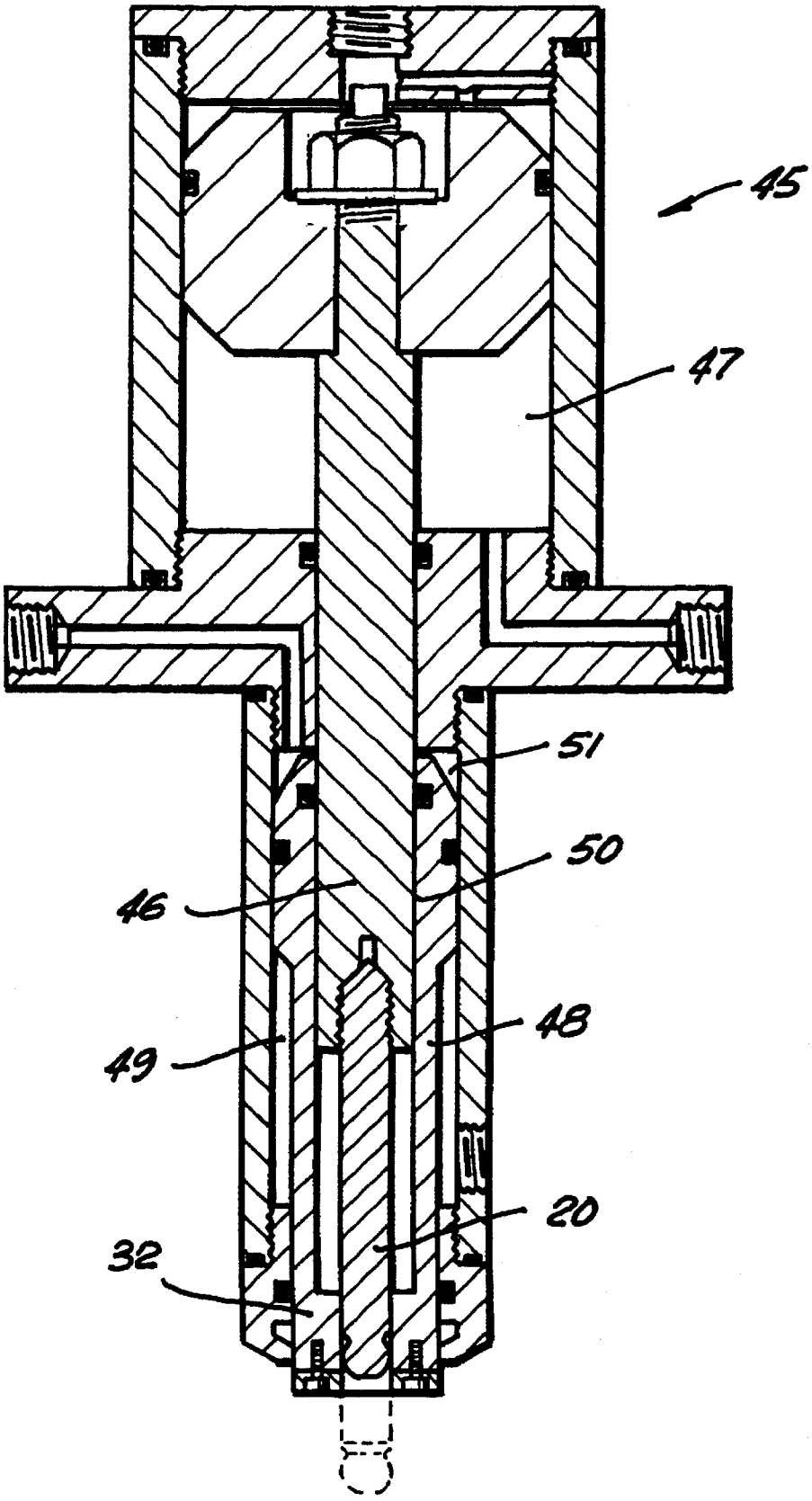
FIG. 12 is a cut-away sectional view showing a multi-cylinder actuating device according to a second aspect of the invention.
Figure 13:
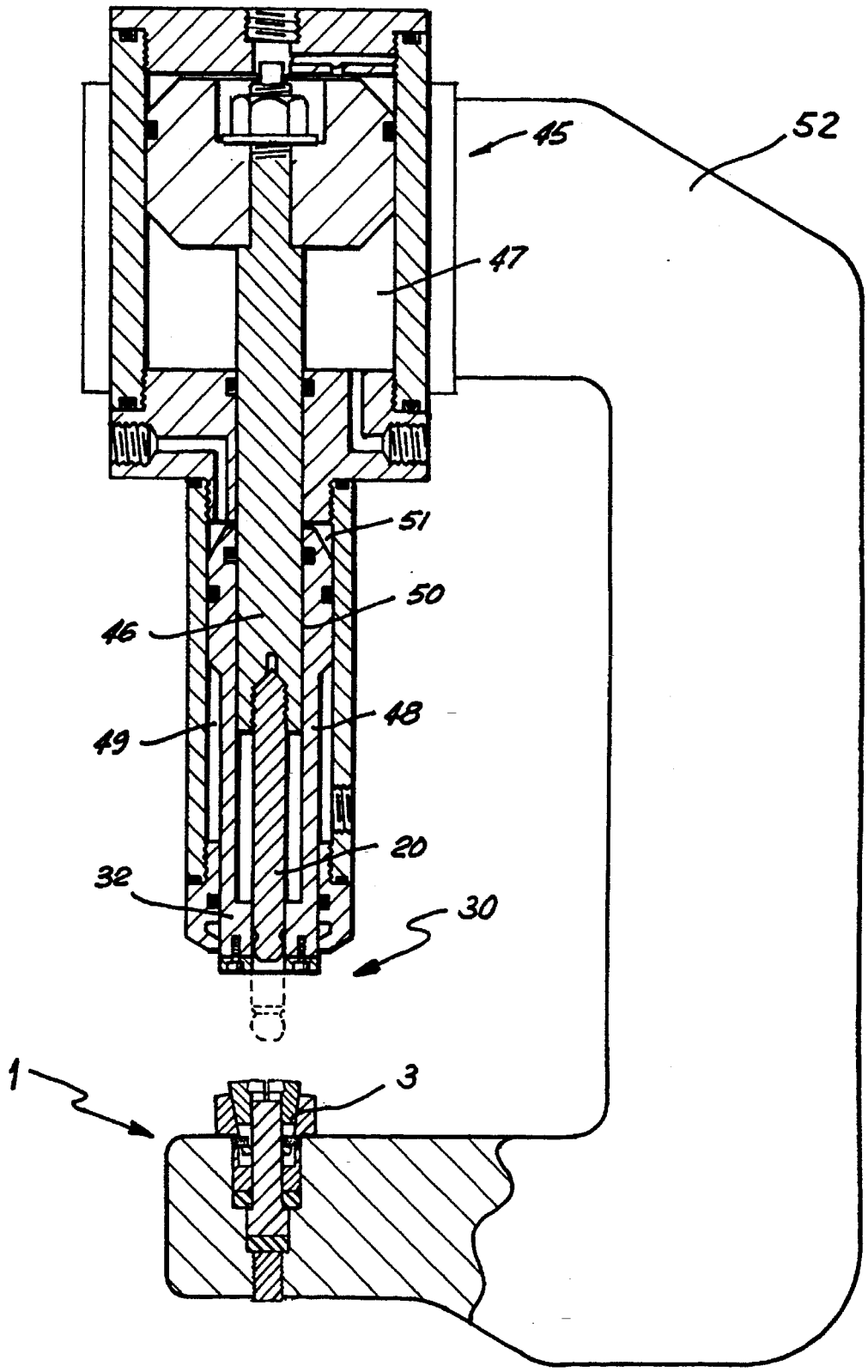
FIG. 13 is a sectional side elevation showing a clinching assembly according to a third aspect of the invention.

The bias means may also comprise positive drive means such as an hydraulic cylinder acting in conjunction with a tapered wedge member as will be described below in relation to FIG. 10 whereby the floating bottom die may be actively driven upwardly into the void during the latter part of the clinching cycle to increase the "mushrooming" effect by flaring the neck of the clinch as the sheet material is driven into the void by the punch. The positive drive means also assists in automatically releasing the clinch from the die.

The apparatus further includes independently operable clamping means 30 to firmly clamp the sheet material between the punch and the die during the clinching operation. The clamping means includes a press having reciprocable clamping member 32 defining a generally annular clamping surface 33 coaxial with the punch 20 and cooperable with a corresponding opposed upper surface 35 of the top die 3. Selective actuation of the clamping press forces clamping member 32 downwardly toward die thereby securely clamping the sheet material between annular clamping surface 33 and the corresponding upper surface 35 of the die. This clamping action simultaneously drives the collets downwardly into the socket 12 formed in the guide block to tightly close the die prior to independent actuation of the punch to form the clinch.

Figure 5:
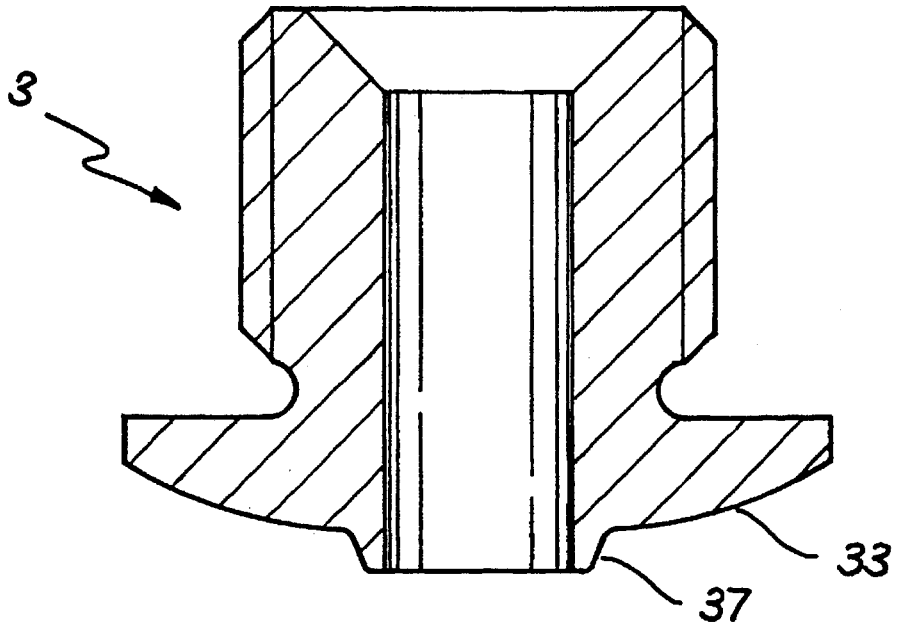
FIG. 5 is a cross-sectional view showing an alternative embodiment of the clamping member of FIGS. 1 and 2, incorporating a convex clamping surface and outwardly protruding annular shoulder.

As shown in FIG. 5, the clamping member is preferably formed with an outwardly protruding convex clamping surface incorporating a protruding annular shoulder 37 to urge material into the void during the clamping operation and thereby enhance the strength of the resultant clinch.

The die also includes restraining means to limit the maximum axial excursion of the collets with respect to the guide block. The restraining means in the embodiments of FIGS. 1 and 4 comprises a pair of mutually opposed locating lugs 40 extending radially inwardly from the guide block into the conical socket 12 and engaging corresponding over-sized apertures 41 formed in the respective collets. This provides a limited degree of free play between the collets and the guide block, corresponding to the radial clearance defined between locating lugs 40 and respective apertures 41. The extreme positions of the collets relative to the guide block correspond respectively to the open and closed configurations of the die.

Figure 6:
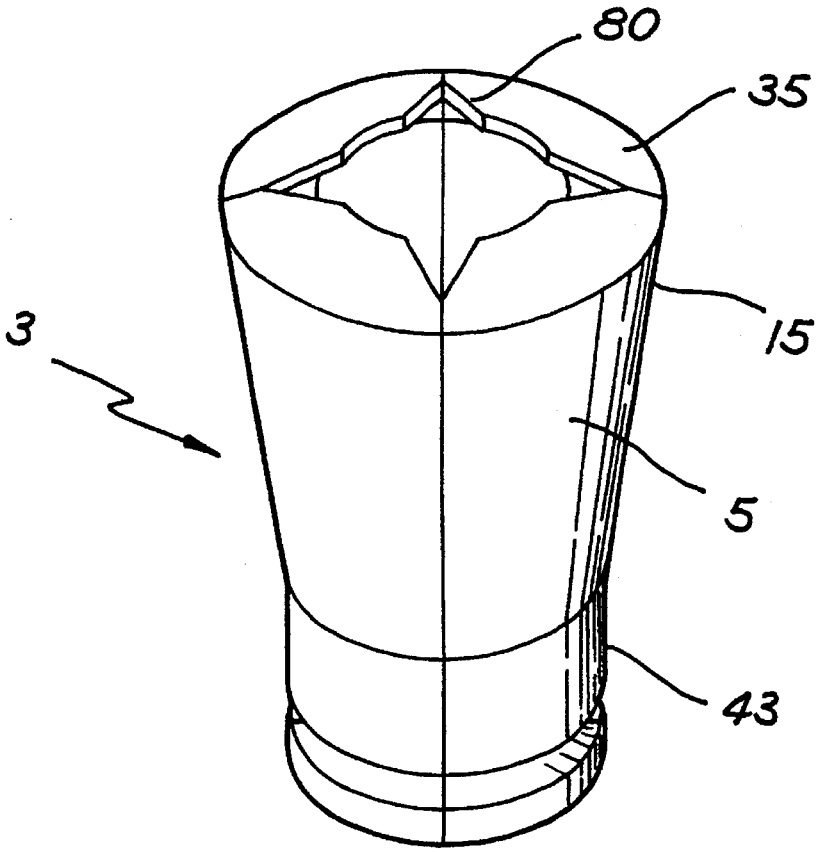
FIG. 6 is a perspective view showing an alternative embodiment of the die, incorporating a plurality of lobes to form non-rotational joints.
Figure 7:
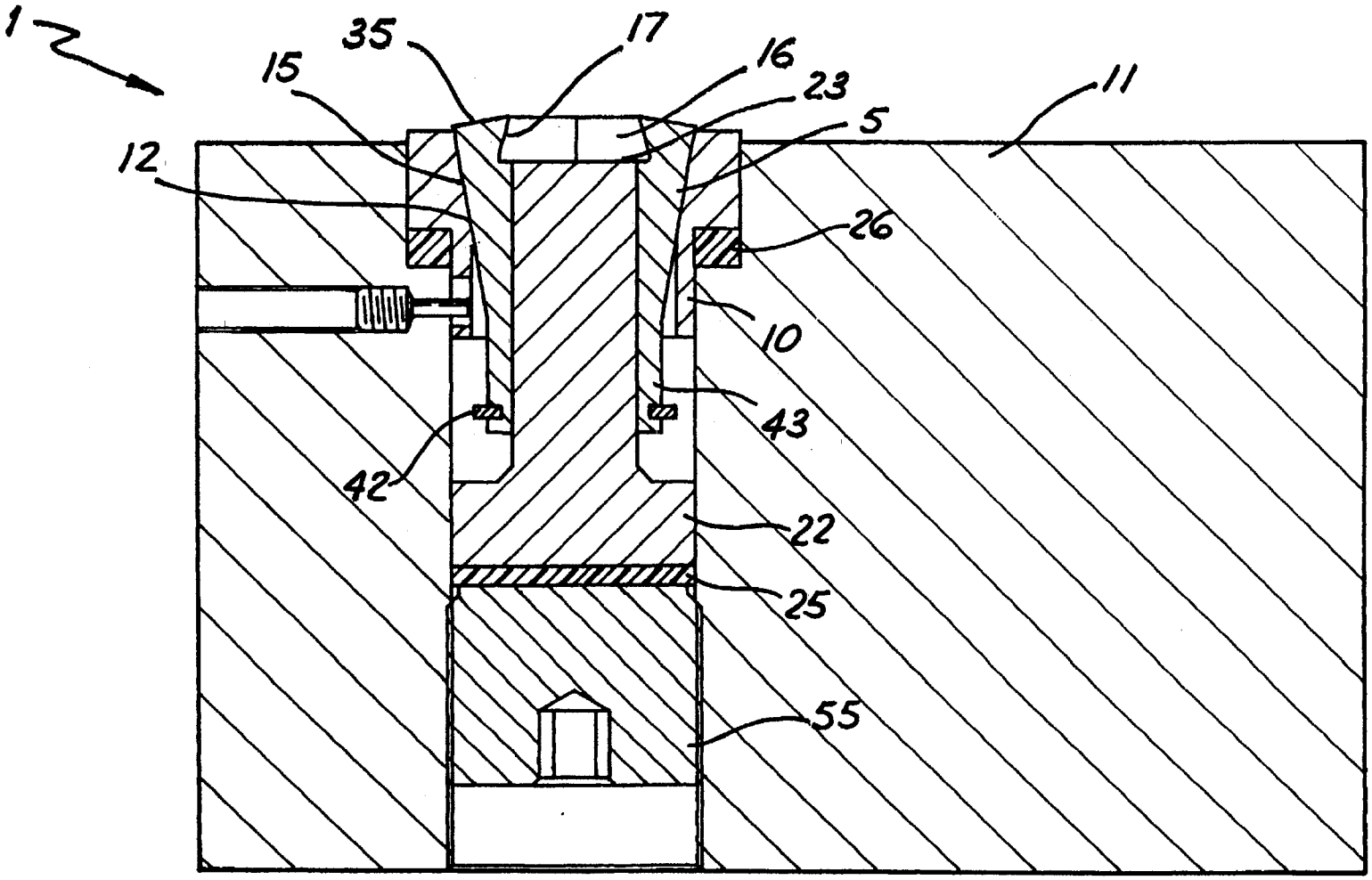
FIG. 7 shows another embodiment of the clinching apparatus wherein the die is retained for limited axial excursion within the guide block by a circlip.
Figure 8:
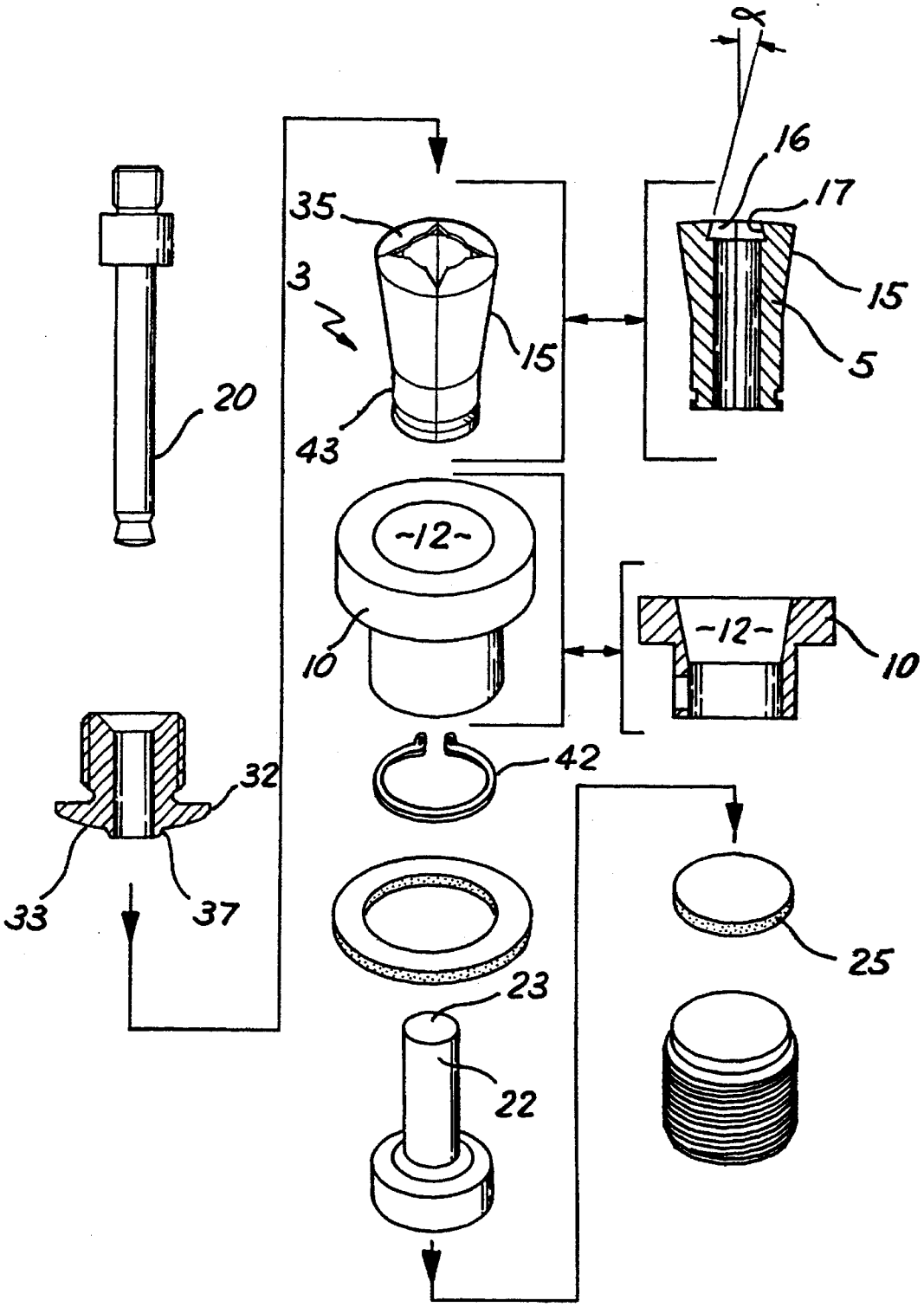
FIG. 8 is an exploded view of the punch and die assembly of the embodiment of FIG. 7.

In the embodiments shown in FIGS. 7 to 11, however, the retaining means comprises a circlip 42 extending around a lower cylindrical neck portion 43 of the die. In these embodiments, the maximum axial excursion of the die in the second direction corresponds to the point at which the circlip abuts the lower surface of the guide block, which is retained within the body with an interference fit. The circlip also serves to keep the die together and operating efficiently, particularly in embodiments where the die comprises three or more forming elements or collets, such as that as shown in FIG. 6.

The clinching apparatus is preferably operated by an independent multi-cylinder actuating device 45 including a first piston 46 reciprocably moveable by a first hydraulic cylinder 47 and a second piston 48 reciprocably moveable independently of the first piston 46 by a second hydraulic cylinder 49. The outer surface 50 of the first piston 46 forms a common inner surface of the second cylinder 49 such that the toroidal operating volume 51 of the second cylinder 49 is defined partly by the first piston. The actuating device 45 acts in cooperation with the clinching apparatus whereby the first piston 46 operates the punch 20 and the second piston 48 independently operates the clamping member 32. Advantageously, the independence of the punch cylinder 47 in relation to the clamping cylinder 49 permits a varying depth of clinch in the overlapping sheets related to sheet thickness and material type, which again increases the guage tolerance of the tool. The actuating device and clinching tool are held in relative coaxial alignment by a generally C-shaped steel support frame 52 as shown in FIG. 10, whereby the integrated clinching assembly can be conveniently transported and used by a single operator.

Turning now to describe the operation of the apparatus, the overlapping portions of sheet material are first inserted between the punch and the top die as best seen in FIG. 1. The clamping press is then actuated to clamp the sheet material between clamping surface 33 of the press and complementary upper surface 35 of the top die, and simultaneously wedge the collets tightly into the guide block to close the die. The clamping action also forces the overlapping sheets together into close abutment prior to actuation of the punch to ensure that an effective clinch is formed even in the event of local irregularities or surface defects in the sheet metal.

With the sheet material clamped firmly in place and the die tightly closed, the punch is then actuated by the first piston 46 under the action of hydraulic cylinder 47 to force the sheet material downwardly into void 16 and outwardly into forming engagement with peripheral surface 17 of the top die thereby to form the clinch 21. It will be appreciated that the outwardly converging tapered configuration of the peripheral surface 17 of the die increases the mechanical interlocking engagement between the overlapping sheets of metal to maximise the pull-out strength of the joint. The internal void angle $\alpha$ (FIG. 8) defined by peripheral surface 17 is preferably in the range of around 5° to 50° to maximise the "mushrooming" effect, particularly in softer materials. A three or four element die such as that shown in FIG. 6 is preferred in applications requiring higher internal void angles to facilitate release once the clinch has been formed. Additionally, the clamping press prevents undesirable local distortion of the metal immediately adjacent the joint during the formation of the clinch and thereby further contributes to the resultant strength of the joint.

In the embodiment of FIGS. 1 and 4, the forming action of the punch simultaneously drives floating bottom die 22 downwardly in the first direction against an opposing force provided by the first compression element 25. Similarly, the guide block is provided with a limited degree of relative movement with respect to the body by means of the second resilient compression elements 26 or 27 to accommodate slight variations in gauge thickness and compliance of the sheet metal.

Once the clinch has been formed, the punch 20 is firstly withdrawn whereupon the first resilient compression element 25 provides a restoring force tending to urge the floating bottom die 22 upwardly toward the void against the lower face of the clinch. The upwardly directed force on the top die is reacted by the clamping assembly such that the die collets are held in the closed position. This action tends to flatten the clinch and further flare the neck outwardly within the void so as to increase the degree of interlocking engagement between the overlapping sheets and thereby maximise the strength of the joint. The clamping press is subsequently withdrawn in the second phase of what is essentially a two stage release cycle, whereby the then unrestrained restoring force provided by the resilient compression element(s) tends to urge the collets upwardly, away from the guide block and into the open configuration. This action provides an ejecting force tending automatically to release the clinch from the die. The maximum upward excursion of the collets in the second direction is limited by retaining lugs 40 acting in conjunction with respective apertures 41 which together define the open configuration for the die.

It will be appreciated that this arrangement provides the dual advantages of increased interlocking engagement provided by the outwardly converging tapered configuration of the void and the flaring function of the bottom die lacking in known fixed die devices, together with positive lateral dimensional control and a simple automatic release mechanism to increase the throughput in high rate production applications. This obviates the need for an independent releasing step which in some prior art devices can require a stripping force of the same order of magnitude as the shear strength of the Joint.

The position of the floating die, the guide block, and the collets can be conveniently adjusted relative to the body by means of threaded adjustment plug 55 to accommodate sheet metal of varying thickness. In addition, the end point of the compression provided by the resilient packing elements can be conveniently adjusted by the incorporation of tuning slots or varying the available volume into which the resilient elements can expand.

Figure 9:
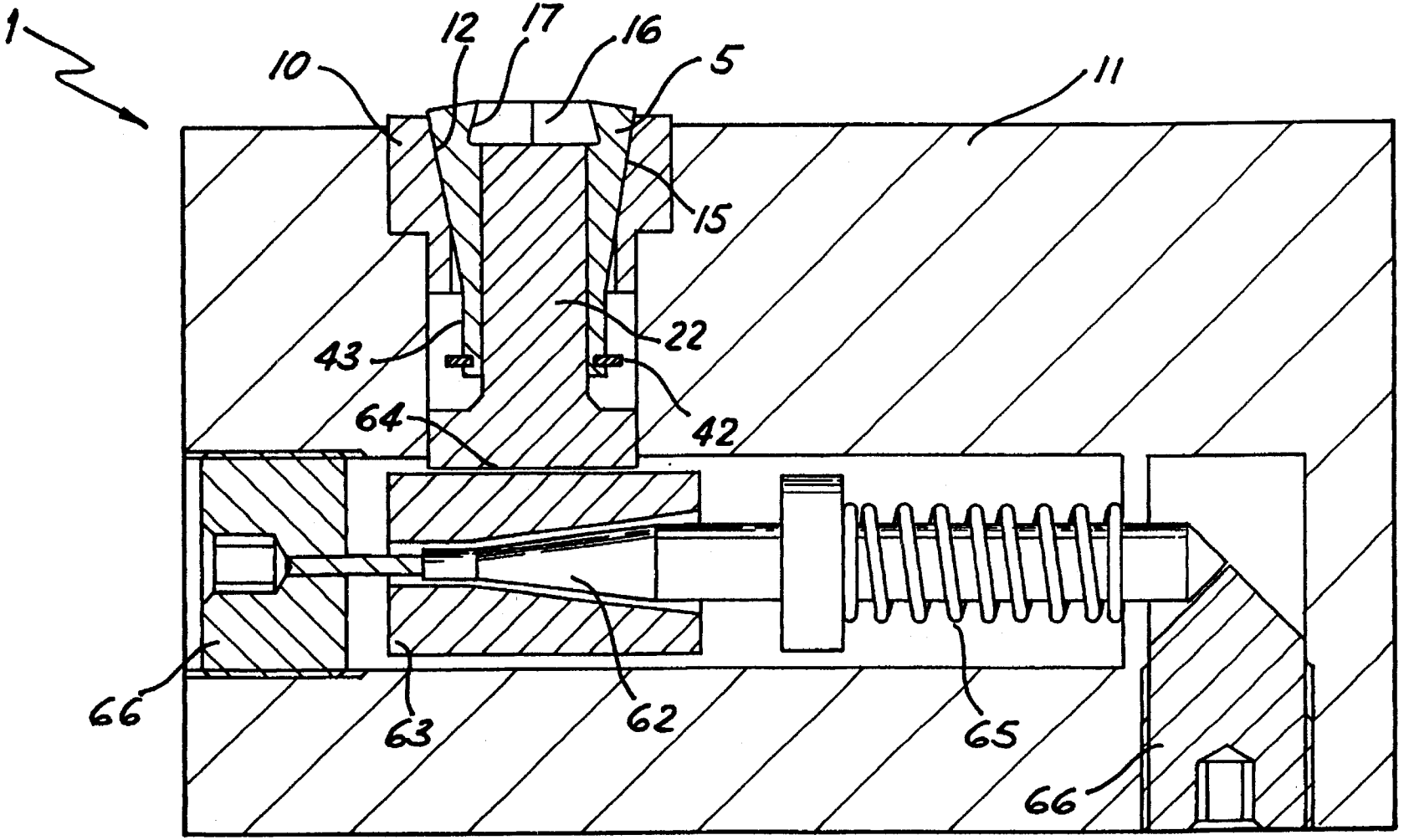
FIG. 9 is a diagrammatic cross-sectional view showing a further embodiment wherein the resilient compression means incorporates a compression spring and wedge assembly operable on the floating die.

In the embodiment of FIG. 9, the floating die is urged upwardly toward the void by a transverse spring biased conical wedge member 62 engaging complementary split collets 63 which abuttingly engage a lower surface.

I claim:

1. A clinching apparatus for joining overlapping portions of sheet material, comprising:

a top die including a plurality of discrete forming elements;

guide means for forcing said forming elements into dose abutment in a dosed configuration in response to movement thereof in a first generally axial direction to define a void region bounded by an effectively continuous peripheral surface of said forming elements, and for permitting said forming elements to move apart into an open configuration in response to movement thereof in a second opposite direction;

a centrally-disposed floating bottom die defining a lower boundary of said void region and mounted for axial sliding movement intermediate said forming elements;

a punch selectively operable in conjunction with said dies to force the sheet material into said void region so as to form a clinch fastening overlapping portions of the sheet material together and thereby to displace said bottom die in the first direction;

clamping means engageable independently of said punch for clamping the sheet material against a corresponding upper surface of said top die and thereby for moving said forming elements in the first direction to close said forming elements; and bias means for controlling displacement of said bottom die in the first direction upon operation of said punch and thereafter for providing a restoring force urging said bottom die in the second direction upon withdrawal of said punch;

wherein said bias means operates on said bottom die in conjunction with said clamping means and said top die tending to effect a flattening and flaring of the clinch upon withdrawal of said punch and prior to disengagement of said clamping means, and subsequently to provide an ejecting force displacing said forming elements in the second direction toward the open configuration upon disengagement of said damping means to release the clinch.

2. A clinching apparatus according to claim 1 wherein said bias means provides an opposing force in response to axial displacement of said bottom die in the first direction.

3. A clinching apparatus according to claim 1 wherein said guide means includes a guide block disposed within a body and defining an outwardly-diverging generally frusto-conical socket.

4. A clinching apparatus according to claim 3 wherein said forming elements comprise at least two complementary collets together defining a generally frusto-conical outer surface slidably engageable with said socket of said guide block such that movement of said collets into said socket in the first direction causes said collets to be forced tightly together into a closed configuration, and movement of said collets outwardly from said socket in the second opposite direction permits said collets to move apart toward the open configuration to release the clinch from said die.

5. A clinching apparatus according to claim 3 further comprising restraining means for limiting the maximum axial extrusion of said forming elements in the second direction relative to said guide block, said restraining means comprising a plurality of locating lugs extending inwardly from said guide block into said conical socket and respectively engaging a corresponding plurality of oversized apertures in the respective said forming elements to provide a limited degree of free play in the first and second directions corresponding to a radial clearance defined between said locating lugs and respective said apertures.

6. A clinching apparatus according to claim 3 wherein a side of said conical socket is inclined at an angle of between approximately 5° and 30° to a longitudinal axis of said socket.

7. A clinching apparatus according to claim 6 wherein said angle is between approximately 8° and 15° to the longitudinal axis.

8. A clinching apparatus according to claim 1 wherein peripheral surfaces of said void region converge in the second direction and define an internal angle of between approximately 5° and 50° to the longitudinal axis.

9. A clinching apparatus according to claim 1 wherein said punch is formed with a domed head.

10. A clinching apparatus according to claim 1 wherein said bias means includes resilient compression means having a definite end point beyond which substantially no further compressive deformation is possible.

11. A clinching apparatus according to claim 10 wherein said guide means includes a guide block disposed within a body, and said resilient compression means comprises a first resilient compression element disposed effectively intermediate said body and said bottom die.

12. A clinching apparatus according to claim 11 further comprising a second resilient compression element disposed effectively between said guide block and said bottom die to permit a degree of independent relative movement between said top die, said guide block, said bottom die, and said body, thereby to accommodate surface irregularities in the sheet material and provide a degree of gauge tolerance.

13. A clinching apparatus according to claim 12 wherein at least one of said first and the second resilient compression elements includes a compressible fluid.

14. A clinching apparatus according to claim 1 wherein said bias means includes positive drive means disposed such that said bottom die is actively driven toward said void region during a clinching cycle to flatten and flare the clinch and thereby increase the degree of mechanical interlocking engagement between overlapping portions of sheet material.

15. A clinching apparatus according to claim 1 wherein said clamping means includes a press having a clamping member defining a generally annular clamping surface coaxial with said punch and disposed such that selective actuation of said clamping press urges said clamping member toward said die, thereby clamping the sheet material between the clamping surface and an upper surface of said top die and simultaneously forcing said forming elements into said guide block to close said top die prior to actuation of said punch to form the clinch.

16. A clinching apparatus according to claim 15 wherein said clamping surface is generally convex in configuration and incorporates an outwardly-protruding generally annular shoulder surrounding said punch to force the sheet material into said void region.

17. A clinching apparatus according to claim 1 wherein said void region defined by said top die is non-circular in cross-sectional configuration, such that the clinch prevents relative rotation of overlapping portions of sheet material.

18. A clinching apparatus according to claim 17 wherein said die comprises at least four complementary collets, wherein remote ends of said collets together from a cylindrical end portion of said top die adapted for sliding engagement within a complementary cylindrical socket within said guide block and wherein said collets are held together by a circlip.

19. A clinching apparatus according to claim 1 wherein said clinching apparatus when operated causes first and second clinching phases to occur;

wherein during the first clinching phase, said bias means provides an opposing force allowing said bottom die progressively to resist the force of said punch, the opposing force acting to squeeze the sheet material trapped between said punch and said bottom die, effecting a first mushrooming of the clinch;

wherein during the second clinching phase, as said punch is withdrawn said bias means continues to force said bottom die upwardly towards said void region, and with said discrete forming elements locked in the closed configuration, said bias means acts on said clinch through said bottom die causing a further flattening and flaring of said clinch; and wherein after the second clinching phase, said clamping means is released, allowing said top die to open and said bias means due to its residual force to eject the formed clinch.

20. A clinching apparatus according to claim 1 wherein said void region is fully defined when said top die is in a closed position by said discrete forming elements being forced into engagement with a tapered guide block by said clamping means.

21. A clinching apparatus according to claim 1 wherein said floating bottom die is mounted coaxially with said punch for limited independent axial sliding movement relative to said forming elements and controlled by said bias means.

22. A clinching apparatus according to claim 1 wherein said bias means is fully compressed when said punch is at its maximum excursion.

23. A clinching apparatus according to claim 1 wherein said bias means is configured to effect a flattening and flaring of the clinch.

24. A clinching apparatus according to claim 1 wherein said guide means includes a guide block having a tapered inner surface, and said clamping means exerts an axial force which is translated by said tapered inner surface into a radial reaction force which restrains said discrete forming elements in a closed position until said clamping means is released.

25. A clinching assembly, comprising:

(a) a clinching apparatus for joining overlapping portions of sheet material, said apparatus including:

a top die comprising a plurality of discrete forming elements;

guide means for forcing said forming elements into close abutment in a closed configuration in response to movement thereof in a first generally axial direction to define a void region bounded by an effectively continuous peripheral surface of said forming elements and for permitting said forming elements to move apart to an open configuration in response to movement thereof in a second opposite direction;

a centrally-disposed floating bottom die defining a lower boundary of said void region and mounted for axial sliding movement intermediate said forming elements;

a punch selectively operable in conjunction with said dies to force the sheet material into said void region so as to form a clinch fastening overlapping portions of the sheet material together and thereby to displace saint bottom die in the first direction; and clamping means engageable independently of said punch for damping the sheet material against a corresponding upper surface of said top die and thereby for moving said forming elements in the first direction to close said forming elements;

bias means for controlling said displacement of said bottom die in the first direction upon operation of said punch and thereafter for providing a restoring force urging said bottom die in the second direction upon withdrawal of said punch;

wherein said bias means operates on said bottom die in conjunction with said clamping means and said top die tending to effect a flattening and flaring of the clinch upon withdrawal of said punch and prior to disengagement of said clamping means, and subsequently to provide an ejecting force displacing said forming elements in the second direction toward the open configuration upon disengagement of said clamping means to release the clinch; and (b) a multi-cylinder actuating device, including:

a first force exerting member reciprocally movable by a first fluid cylinder; and a second force exerting member reciprocally movable independently of said first member by a second fluid cylinder, an outer surface of said first member forming an inner surface of said second cylinder such that an operating volume of said second cylinder is defined partly by said first member;

wherein said first member operates said punch; and wherein said second member independently operates said clamping means.

26. A clinching assembly according to claim 25 wherein said actuating device and said clinching apparatus are maintained in relative coaxial alignment by a generally C-shaped support frame.

27. A clinching assembly according to claim 25 wherein said first and second fluid cylinders are hydraulically operable.

28. A clinching assembly according to claim 25 wherein said first and second cylinders are pneumatically operable.

29. A clinching assembly according to claim 25 further comprising means for maintaining said actuating device and said clinching apparatus in relative coaxial alignment.

30. A method of joining overlapping portions of sheet material in a clinching apparatus, comprising the steps of:

providing overlapping portions of sheet material;

moving a plurality of discrete forming elements in a first direction and thereby forcing the elements together into a closed configuration by guide means, thereby forming a void region bounded by an effectively continuous peripheral surface of the forming elements and a bottom surface defined by an upper surface of a floating bottom die;

engaging clamping means with the sheet material, thereby clamping the overlapping portions of sheet material against an upper surface of the forming elements and thereby retaining the forming elements in the closed configuration;

operating a punch thereby forcing the sheet material into the void region, and thereby displacing the floating bottom die in the first direction while controlling displacement of the bottom die in the first direction by exerting a restoring force provided by bias means against the bottom die in a direction opposite to the first direction, such that a clinch fastening the overlapping portions together is formed;

withdrawing the punch such that the restoring force provided by the bias means urges the bottom die in a second opposite direction;

retaining the forming elements in the closed configuration by the clamping means such that the restoring force upon withdrawal of the punch causes the bottom die to effect a flattening and flaring of the clinch; and after said retaining step, disengaging the damping means such that the bias means provides an ejecting force on the bottom die and hence the clinch, which in turn displaces the forming elements in the second direction toward an open configuration, and thereby releasing the clinch.

31. A method according to claim 30 wherein the restoring force causes the bottom die progressively to resist the force of the punch, and the opposing forces acting on the punch and the bottom die squeeze the sheet material trapped therebetween, thereby forming the clinch.

32. A method according to claim 30 wherein said engaging clamping means step includes forcing the discrete forming elements into engagement with a tapered guide block by the clamping means.

* * * * *